US008549687B1

(12) United States Patent
Alexander

(10) Patent No.: US 8,549,687 B1
(45) Date of Patent: Oct. 8, 2013

(54) MULTI-FUNCTION HAND TOOL

(76) Inventor: Matthew David Alexander, Evan Mills, NY (US)

( * ) Notice: Subject to any disclaimer, the term of this patent is extended or adjusted under 35 U.S.C. 154(b) by 238 days.

(21) Appl. No.: 13/150,554

(22) Filed: Jun. 1, 2011

(51) Int. Cl.
*B25B 7/22* (2006.01)

(52) U.S. Cl.
USPC ..... 7/128; 7/168

(58) Field of Classification Search
USPC ..... 7/128–131, 168; 81/177.4, 416
See application file for complete search history.

(56) References Cited

U.S. PATENT DOCUMENTS 5,664,274 A * 9/1997 Collins ..... 7/129
6,038,723 A * 3/2000 Nabors et al. ..... 7/128
6,092,444 A * 7/2000 Hsiao ..... 81/440
6,243,901 B1 * 6/2001 Elsener et al. ..... 7/118
6,257,106 B1 * 7/2001 Anderson et al. ..... 81/440
6,523,203 B2 * 2/2003 Harrison ..... 7/128
6,622,327 B1 * 9/2003 Rivera ..... 7/128
7,530,129 B2 * 5/2009 Yale et al. ..... 7/128
7,568,408 B2 * 8/2009 Tsuda ..... 81/427.5
7,926,136 B2 * 4/2011 Yale et al. ..... 7/125
2006/0150340 A1 * 7/2006 Yale et al. ..... 7/128

* cited by examiner

*Primary Examiner* — David B Thomas
(74) *Attorney, Agent, or Firm* — Michael I. Kroll

(57) ABSTRACT

A multi-function hand tool having a housing comprising two housing halves pivotally connected with disconnecting pliers. Each housing half contains a plurality of selectively removeable pivoting tools therein to perform a plurality of functions. Pliers having two releasable portion provides a pivotable connection between the two housing halves and are releasable to facilitate use of two tools simultaneously.

19 Claims, 10 Drawing Sheets

CLOSED
POSITION

MULTI-FUNCTION HAND TOOL

BACKGROUND OF THE INVENTION

1. Field of the Invention

The present invention relates generally to hand tools and, more specifically, to a multi-function hand tool capable of performing a plurality of functions. The multi-function hand tool of the present invention comprises a housing having a first half and an opposing second half pivotally connected together with disconnecting pliers.

A plurality of interchangeable tools are pivotally disposed within each half that can be selectively pivoted out of their respective housing halves for usage thereof. The pliers have a quick release to separate the two portions thereof enabling the user to perform tasks requiring two separate tools.

A slidable plate is also provided to lock the two housing halves in linear relation to provide enhanced leverage when needed.

2. Description of the Prior Art

There are other multi-function tools designed for versatility.

While these tools may be suitable for the purposes for which they where designed, they would not be as suitable for the purposes of the present invention as heretofore described.

It is thus desirable to provide a multi-function hand tool having a handle comprising a first housing half and a separable second housing half pivotally connected with disconnecting pliers It is further desirable to provide a multi-function hand tool wherein each housing half includes a plurality of pivoting tools disposed therein. Disconnection of the pliers separate the two housing halves to enable the user to use two available tools simultaneously.

SUMMARY OF THE PRESENT INVENTION

A primary object of the present invention is to provide a multi-function hand tool capable of performing a plurality of tasks.

Another object of the present invention is to provide a multi-function hand tool comprising a housing having a first housing half and a second housing half with each housing half having open ends and an open side adjacent to the opposing housing half.

Yet another object of the present invention is to provide a multi-function hand tool wherein the first housing half and the second housing half are pivotally fastened together with disconnecting pliers.

Still yet another object of the present invention is to provide a multi-function hand tool wherein a plurality of tool members are pivotally disposed within each housing half.

Another object of the present invention is to provide a multi-function hand tool having a quick release mechanism for the pliers to separate the two housing halves for individual use or to use two tools simultaneously.

Yet another object of the present invention is to provide a multi-function hand tool having a slidable bar therein to lock the two housing halves in linear relation with one another.

Still yet another object of the present invention is to provide a multi-function hand tool wherein the external portion of the housing halves proximal the open sides thereof have a plurality of evenly spaced apart ticks to indicate units of measurement.

Additional objects of the present invention will appear as the description proceeds.

The present invention overcomes the shortcomings of the prior art by providing a multi-function hand tool having a housing comprising two housing halves pivotally connected with disconnecting pliers. Each housing half contains a plurality of selectively removeable pivoting tools therein to perform a plurality of functions. Pliers having two releasable portion provides a pivotable connection between the two housing halves and are releasable to facilitate use of two tools simultaneously.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
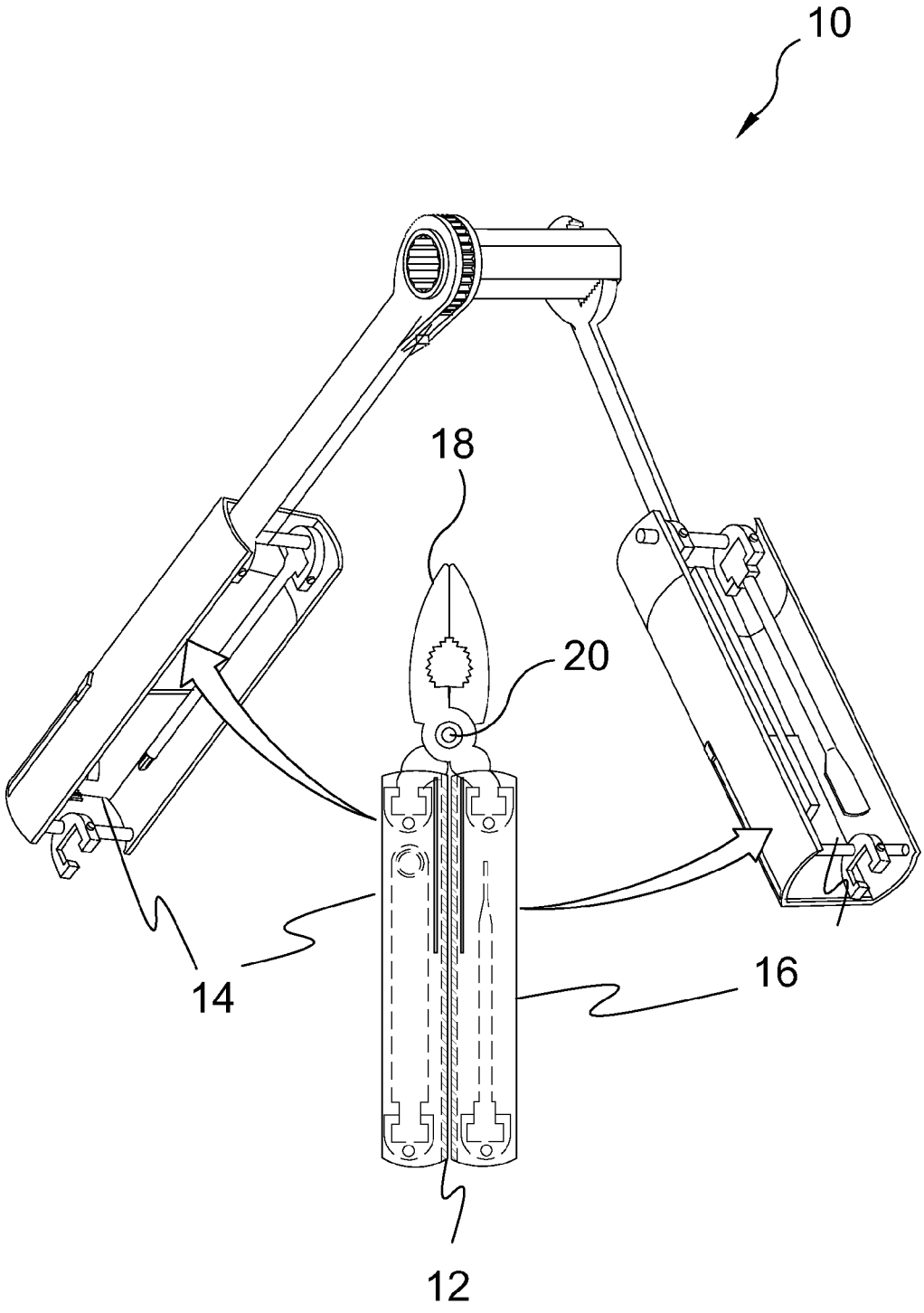
FIG. 1 is an illustrative view of the multi-function hand tool of the present invention.

Turning now descriptively to the drawings, in which similar reference characters denote similar elements throughout the several views, the figures illustrate the Multi-Function Hand Tool of the present invention. With regard to the reference numerals used, the following numbering is used throughout the various drawing figures.

| | |
|---|---|
| 10 | Multi-Function Hand Tool of the present invention |
| 12 | housing |
| 14 | first housing half |

-continued

| | |
|---|---|
| 16 | second housing half |
| 18 | pliers |
| 19 | plier quick release mechanism |
| 20 | quick release button of 19 |
| 22 | female adapter coupling |
| 24 | pivot rod |
| 26 | interchangeable tool member |
| 28 | male adapter |
| 30 | first portion of 18 |
| 32 | second portion of 18 |
| 34 | rigid slidable plate |
| 36 | finger grip of 34 |
| 38 | slot for finger grip |
| 40 | tick mark |
| 42 | indicia |
| 44 | pivot rod aperture |
| 46 | female adapter port |
| 47 | tool quick release mechanism |
| 48 | tool quick release button |
| 50 | flex head |
| 52 | interchangeable ratchet tool |
| 54 | channel of 22 |
| 56 | shaft of 28 |
| 58 | flange of 46 |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the multi-function hand tool 10 of the present invention. The present invention is a folding multi-tool 10 comprising a housing 12 with first 14 and second 16 housing halves pivotally connected by pliers 18. A pliers quick release button 20 separates both portions. The device is designed to adapt a plurality of attachable detachable tools and allows the user to utilize both halves of the device individually.

Figure 2:
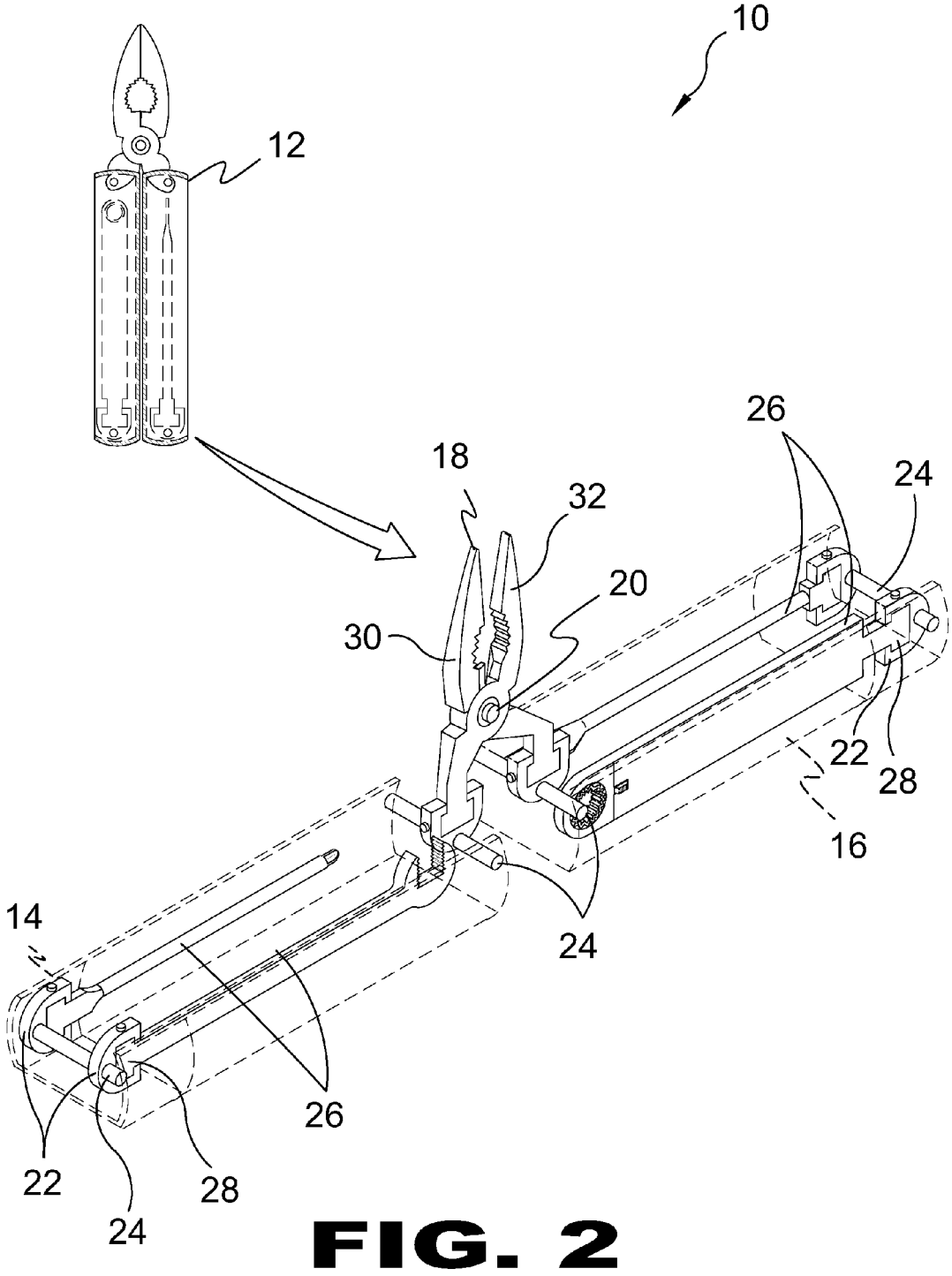
FIG. 2 is an illustrative view of the multi-function hand tool of the present invention.

FIG. 2 is an illustrative view of the multi-function hand tool 10 of the present invention. Each housing half 14,16 of the housing 12 has a channel with female adapter couplings 22 mounted on a pivot rod 24. Each coupling 22 allows interchangeable tools 26 having male adapter ends 28 to be inserted within said coupling 22. Additionally the pliers 18 have a first 30 and second 32 portion that are pivotally connected by a quick release button 20 that allows the device to be used as two tools.

Figure 3:
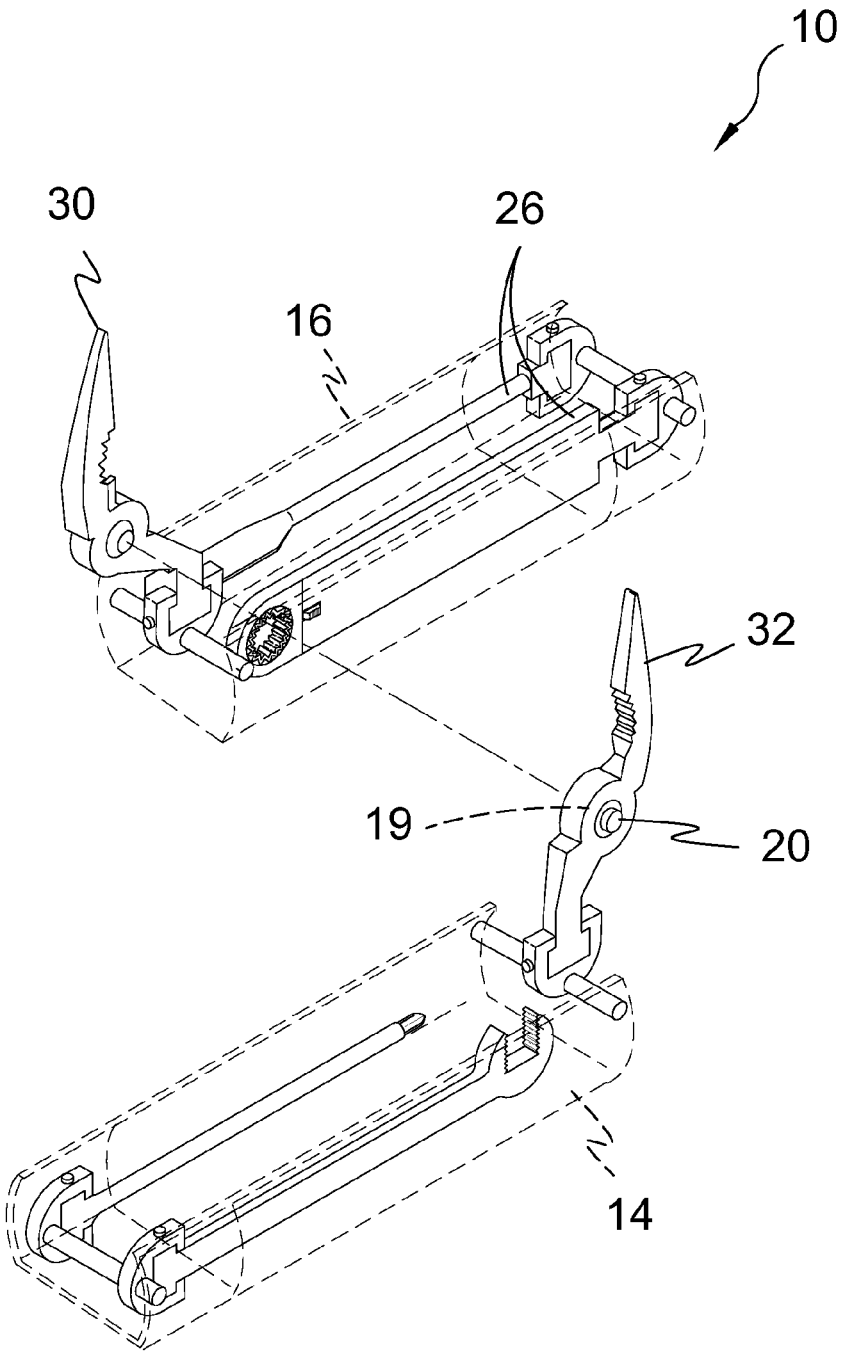
FIG. 3 is a perspective view of the multi-function hand tool of the present invention.

FIG. 3 is a perspective view of the multi-function hand tool 10 of the present invention. Shown is the present invention with first plier portion 30 and the second plier portion 32 disconnected by the plier quick release mechanism button 20 of the quick release mechanism 19 to allow for the individual use of the first housing half 14 and the second housing half 32 and their respective interchangable tool members 26.

Figure 4:
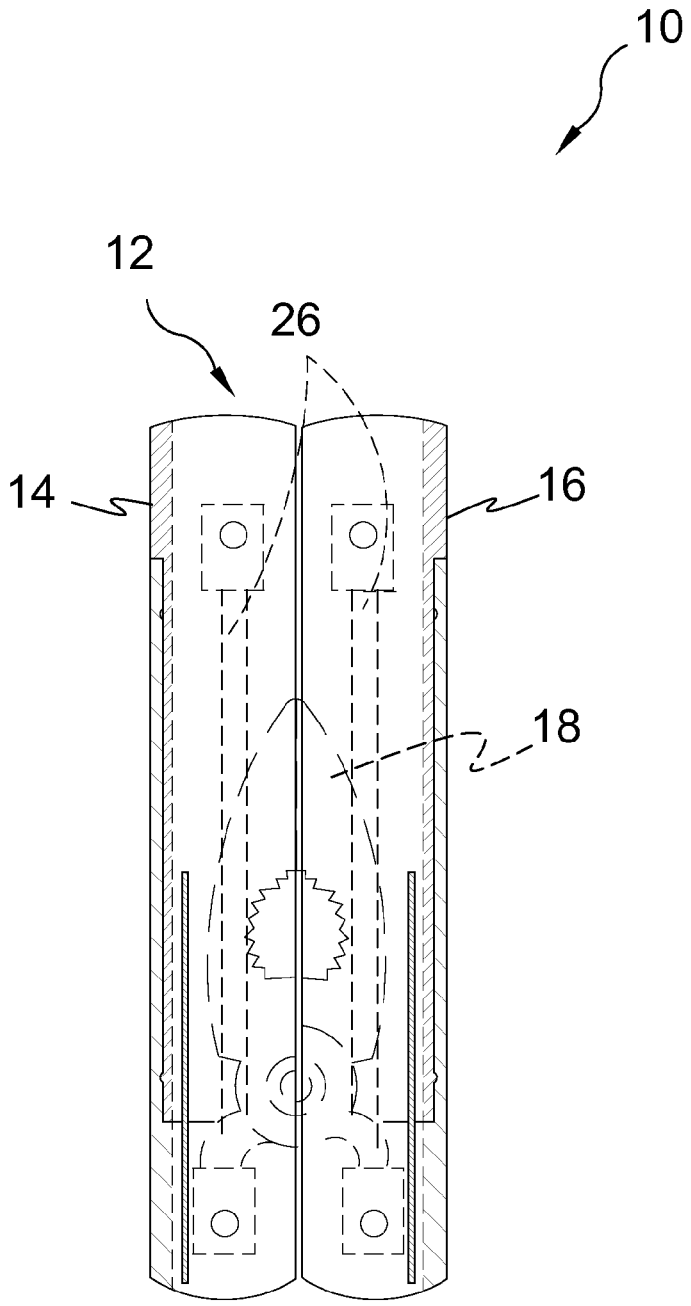
FIG. 4 is a sectional view of the multi-function hand tool of the present invention.

FIG. 4 is a sectional view of the multi-function hand tool 10 of the present invention. Shown is a sectional view of the present invention in a folded position. The first half 14 and second half 16 of the housing 12 are flush to one another in parallel relation with the interchangeable tool members 26 and pliers 18 residing therein.

Figure 5:
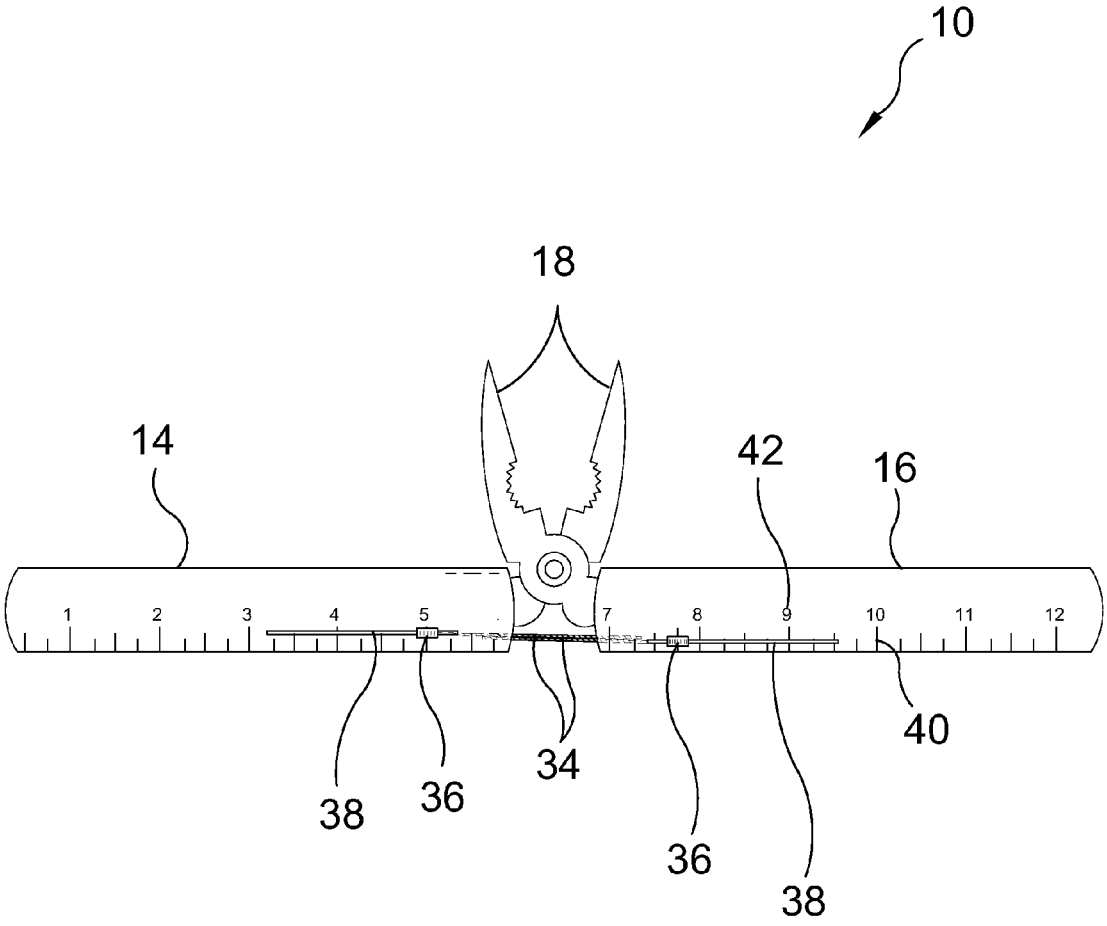
FIG. 5 is a sectional view of the multi-function hand tool of the present invention.

FIG. 5 is a sectional view of the multi-function hand tool 10 of the present invention. Shown is the first housing half 14 and the second housing half 16 open and locked into a linear relation with each other with a pair of overlapping slidable plates 34 moved into position by an exteriorly disposed finger grip 36 that travels along a slot 38 in each housing half. A plurality of evenly spaced tick marks 40 and indicia 42 are disposed proximal the edge of each housing half opposing the pliers 18 to provide units of measurement for use as a ruler.

Figure 6:
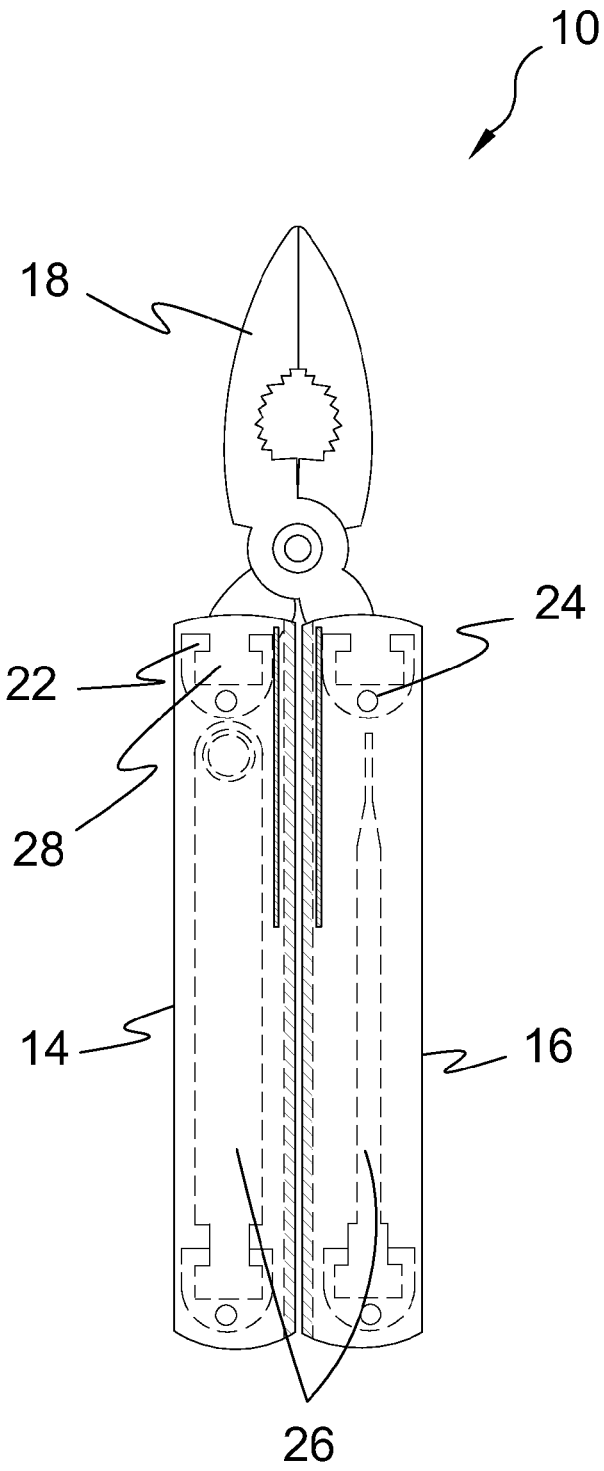
FIG. 6 is a sectional view of the multi-function hand tool of the present invention.

FIG. 6 is a sectional view of the multi-function hand tool 10 of the present invention. Shown is the present invention having the configuration of a folding multi-tool comprising first 14 and second 16 housing halves that are pivotally connected by forming pliers 18 that are releasable. Within the pivotal housing halves are a plurality of female adapters couplings 22 that pivot around pivot rods 24 for receiving the male adapter 28 of the interchangeable tool members 26 and the pliers 18.

Figure 7:
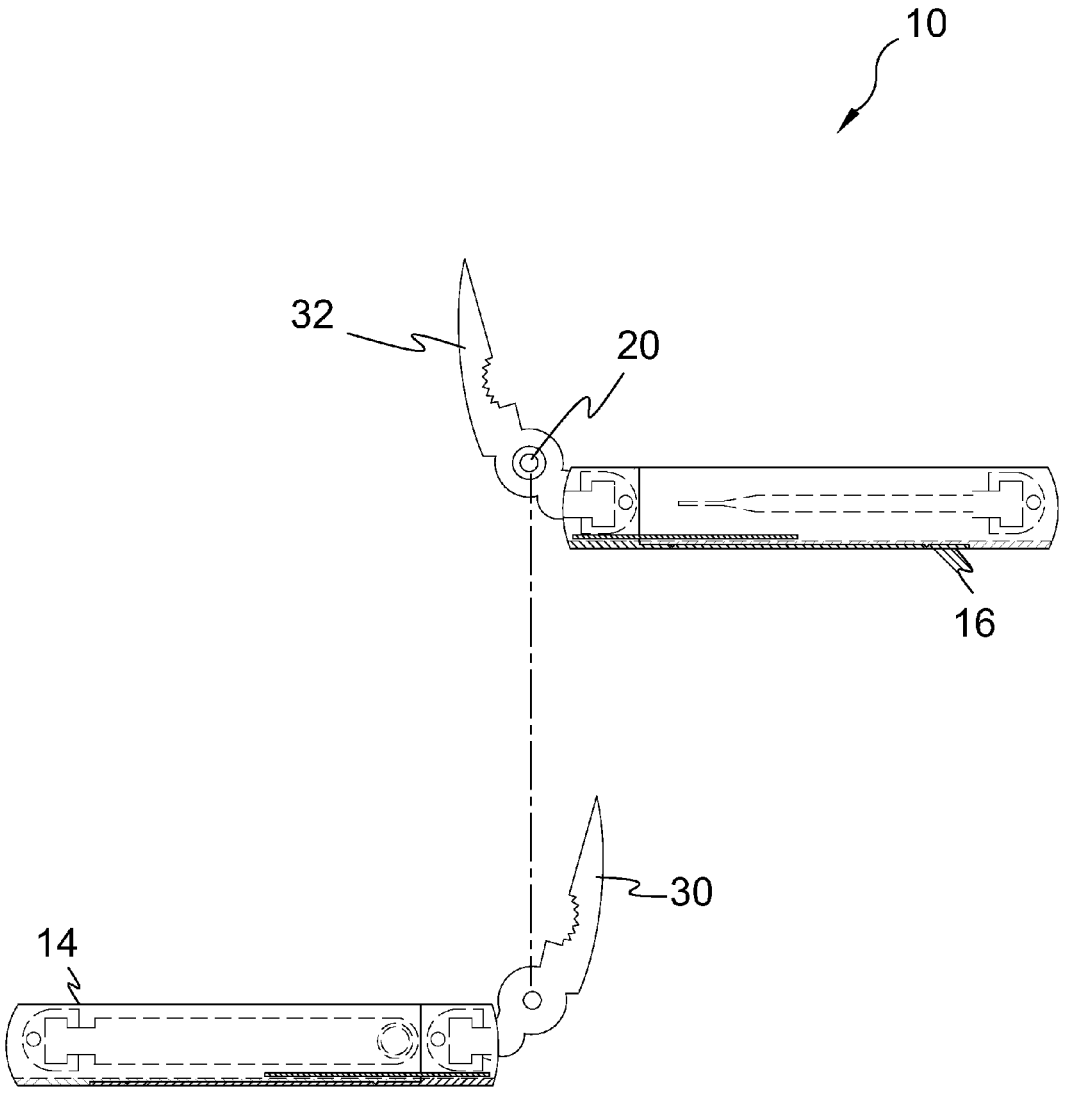
FIG. 7 is a sectional view of the multi-function hand tool of the present invention.

FIG. 7 is a sectional view of the multi-function hand tool 10 of the present invention. Shown is the present invention separated into two individual manual tool components by separating the first plier portion 30 of the first housing half 14 from the second plier portion 32 of the second housing half 16 by depressing the plier quick release mechanism button 20 whereby the user can now use two individual tools in conjunction with one another.

Figure 8:
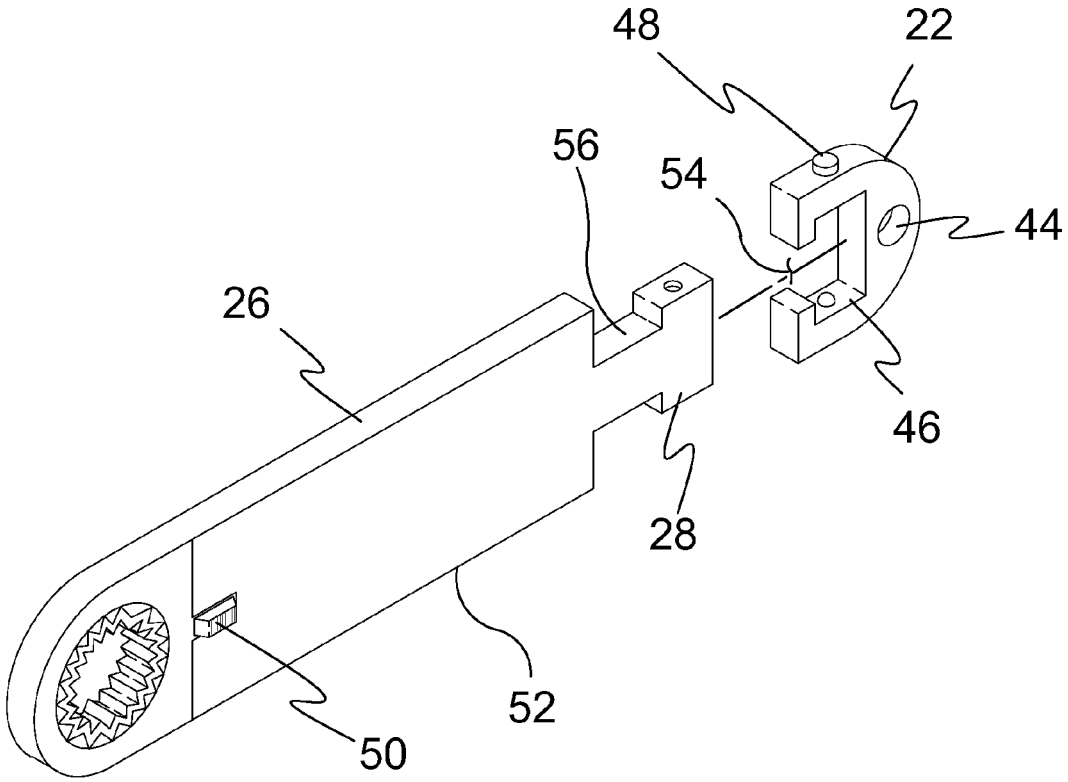
FIG. 8 is a perspective view of the multi-function hand tool of the present invention.

FIG. 8 is a perspective view of an interchangeable tool member 26 of the multi-function hand tool. Shown is a female tool adapter coupling 22 with a pivot rod aperture 44 that mounts on a pivot rod. Each coupling 22 allows interchangeable tools 26 having male adapter ends 28 and shaft 56 to be inserted within a female adapter port 46 and its related channel 54 defined by inwardly projecting flanges 58 in said coupling 22. The coupling adapter 22 has a tool release mechanism 47 with a tool release button 48 allowing a tool to be removed and replaced with another. Also shown is a flex head 50 integral with the interchangeable ratchet tool 52.

Figure 9:
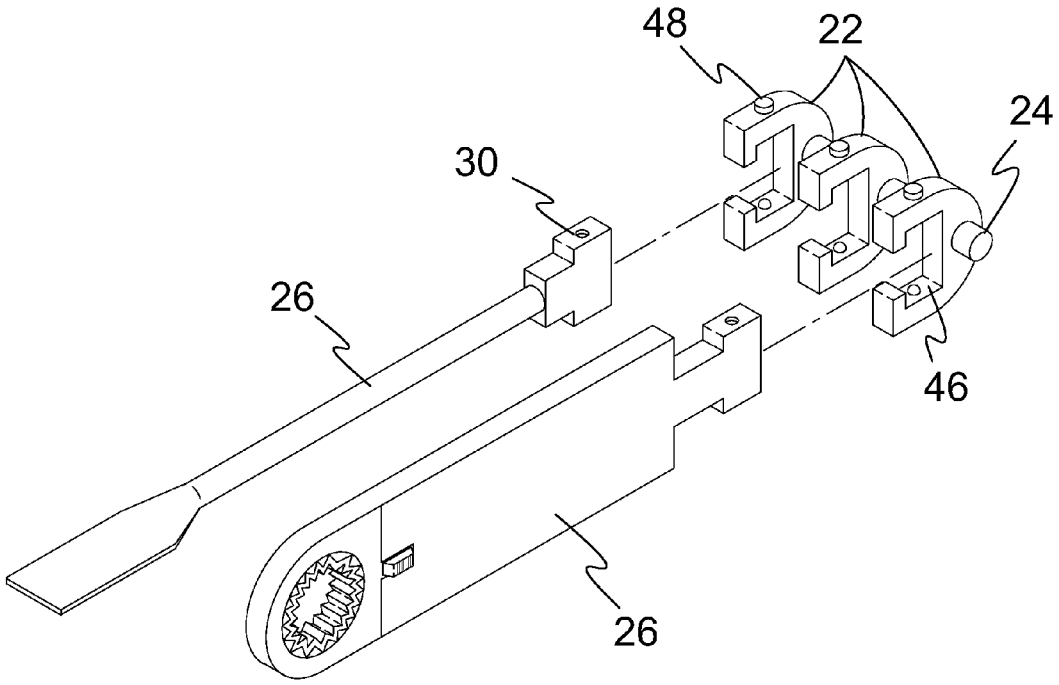
FIG. 9 is a perspective view of the multi-function hand tool of the present invention.

FIG. 9 is a partially exploded perspective view of mounting means of the interchangeable tool members 26 of the multi-function hand tool of the present invention. Shown is a plurality of female adapter couplings 22 pivotally mounted on a pivot rod 24. The couplings 22 include a tool quick release mechanism 47 with button 48 and a female adapter port 46 for receiving the male adapters 30 of the interchangeable tool members 26.

Figure 10:
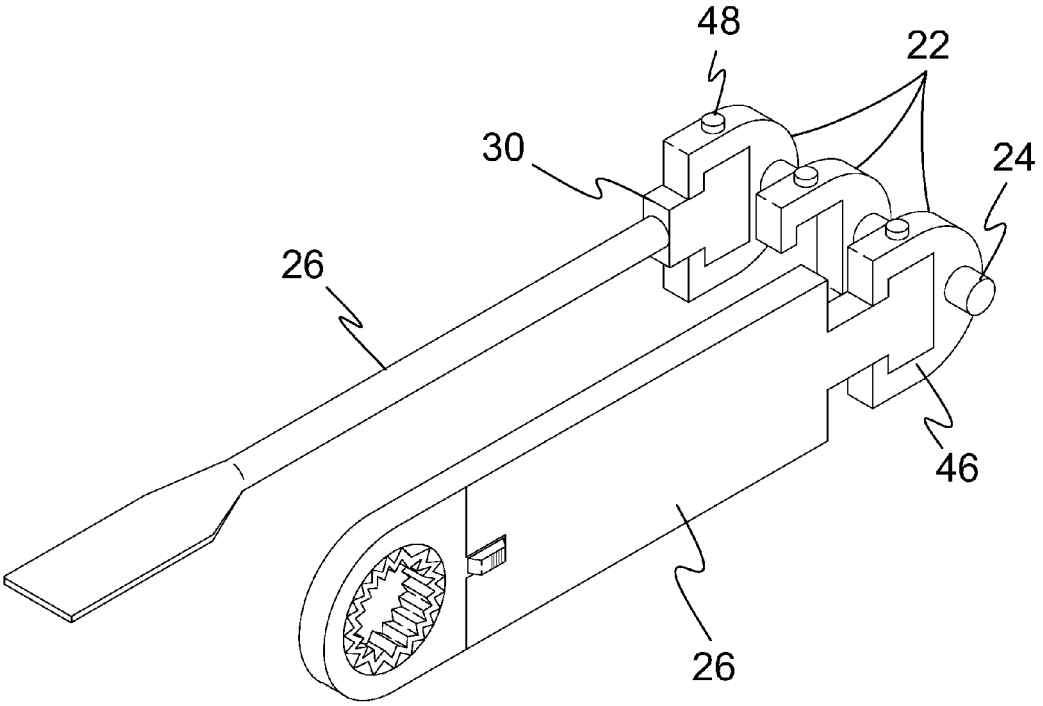
FIG. 10 is a perspective view of the multi-function hand tool of the present invention.

FIG. 10 is an assembled perspective view of mounting means of the interchangeable tool members 26 of the multi-function hand tool of the present invention. Shown is a plurality of female adapter couplings 22 pivotally mounted on a pivot rod 24. The couplings 22 include a tool quick release button 48 and a female adapter port 46 for receiving the male adapters 30 of the interchangeable tool members 26.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multi-function hand tool comprising:

a) a housing having a first housing half and a pivotally connected second housing half, each said housing half having open ends and three side walls and an open side with the open sides oriented to sit flush against one another when in the closed position;

b) a plurality of interchangeable tool members;

c) a pair of pliers pivotally communicating with said first housing half and said second housing half; and d) means for pivotally mounting said interchangeable tool members and said pliers within their respective housing halves comprising:

i) opposing pivot rods disposed transversely between the side walls proximal said open side and situated toward each end of their respective housing halves;

ii) at least one female adapter disposed on each said pivot rod with a pivot rod aperture for receiving said pivot rod therethrough and a female adapter port with a narrower channel extending therefrom; and iii) a male adapter disposed at the ends of said interchangeable tool members sized and shaped to conform with said female adapter ports of said female adapter couplings.

2. The multi-function hand tool according to claim 1, wherein said mounting means further comprises a tool quick release mechanism that locks said male adapter within said female adapter port.

3. The multi-function hand tool according to claim 2, wherein said tool quick release mechanism includes a button that activates said mechanism to release said male adapter to facilitate the removal of said interchangeable tools therefrom.

4. The multi-function hand tool according to claim 3, wherein a plurality of different interchangeable tool members are available for selection according to the needs of the user.

5. The multi-function hand tool according to claim 4, wherein a plurality of said interchangeable tool members are selectively engageable with said adapter couplings on said piston rod opposing said piston rod on which said plier portion is mounted.

6. The multi-function hand tool according to claim 3, wherein installation of said interchangeable tool members is accomplished by placing said male adapter in alignment with said female adapter port in side by side relation and inserting it therein with said shaft extending through said channel and said quick release mechanism locking it in to prevent the sideways casual displacement thereof.

7. The multi-function hand tool according to claim 1, wherein said pliers comprise a first plier portion and a second plier portion pivotally connected with a plier quick release mechanism.

8. The multi-function hand tool according to claim 7, wherein said plier quick release mechanism includes a plier quick release button that releases and separates said plier portions when depressed.

9. The multi-function hand tool according to claim 8, wherein separation of said plier portion enables the user to utilize two of said interchangeable tool members in concert with each other.

10. The multi-function hand tool according to claim 9, wherein said plier portions include said male adapters disposed on the distal ends thereof for the releasable connection with their respective female adapter couplers and pivotally disposed on their related piston rods thereby forming the pivotal connection between first housing half and said second housing half.

11. The multi-function hand tool according to claim 1, further comprising a rigid slidable bar disposed within each said housing half for deployment when said housing halves are opened and in linear relation wherein said deployed slidable bars overlap and extend into the adjacent housing half to lock said housing halves in linear position to provide additional leverage when using said interchangeable too members.

12. The multi-function hand tool according to claim 11, wherein said slideable bar is extracted and retracted with an external finger grip in communication with said slidable bar that travels along a longitudinal slot disposed in the side wall proximal said open side of said housing half.

13. The multi-function hand tool according to claim 1, wherein said side walls on one side of said housing includes a plurality of evenly spaced tick marks and indicia indicating units of measurement.

14. A multi-tool to provide a plurality of selectable functions with a single tool comprising:

a) a housing having a first housing half and a pivotally connected second housing half, each said housing half having open ends and three side walls and an open side with the open sides oriented to sit flush against one another when in the closed position;

b) a plurality of interchangeable tool members;

c) a pair of pliers having a first pier portion and a second plier portion pivotally communicating with said first housing half and said second housing half providing the pivoting connection thereof;

d) opposing pivot rods disposed transversely between said side walls proximal said open side and situated toward each end of their respective housing halves;

e) at least one female adapter disposed on each said pivot rod with a pivot rod aperture for receiving said pivot rod therethrough and a female adapter port with a pair of medially projecting flanges forming a channel extending therebetween; and f) a male adapter disposed at the end of the shaft of said interchangeable tool members and said plier portions sized and shaped to conform with said female adapter port and channel of said female adapter couplings.

15. The multi-tool recited in claim 14, wherein said female adapter coupling further comprises a tool quick release mechanism for locking said male adapter when placed within said female adapter port and a tool quick release button for releasing said male adapter when depressed.

16. The multi-tool recited in claim 15, wherein a plurality of interchangeable tool members enable the user to selectively insert and remove said tools and combinations thereof as needed to accomplish the task at hand.

17. The multi-tool recited in claim 14, wherein said first plier portion and said second plier portion are pivotally connected by a plier quick release mechanism and provides the pivoting action between said housing halves, said plier quick release mechanism includes a plier quick release button that separates said plier portions and their respective housing halves to enable the user to use two different tools simultaneously.

18. The multi-tool recited in claim 14, further comprising a rigid slidable bar disposed within each said housing half for deployment when said housing halves are opened and in linear relation wherein said deployed slidable bars overlap and extend into the adjacent housing half to lock said housing halves in linear position to provide additional leverage when using said interchangeable tool members said slideable bars are extracted and retracted with external finger grips in communication with said slidable bars and travels along longitudinal slots disposed in side walls proximal said open side of said housing half.

19. The multi-tool recited in claim 14, further comprising a ruler element wherein said side walls on one side of said housing includes a plurality of evenly spaced tick marks and indicia indicating units of measurement.

* * * * *